United States Patent [19]

Gupalo et al.

[11] 4,135,123

[45] Jan. 16, 1979

[54] TRANSFORMER CONTROL DEVICE

[76] Inventors: Jury D. Gupalo, ulitsa Anri Barbjusa, 22-26, kv. 25; Vladimir A. Nagaitsev, ulitsa Stroitelei, 26, kv. 6; Vladimir A. Troitsky, ulitsa Bratislavskaya, 8, kv. 86; Nikolai G. Bely, ulitsa Stepana Razina, 3, kv. 10, all of Kiev; Dmitry N. Parshin, ulitsa Kommunisticheskaya, 55, kv. 80, Toliatti; Pavel A. Zhinzhikov, ulitsa Kostycheva, 41, kv. 195, Bryansk, all of U.S.S.R.

[21] Appl. No.: 737,992

[22] Filed: Nov. 2, 1976

[51] Int. Cl.[2] ..... G05F 1/38

[52] U.S. Cl. ..... 323/56; 323/83

[58] Field of Search ..... 307/254; 323/6, 44 R, 323/45, 56, 83, 89 R; 363/75, 90, 91, 93

[56] References Cited

U.S. PATENT DOCUMENTS

| | | | |
|---|---|---|---|
| 2,729,772 | 1/1956 | Perkins | 323/56 X |
| 3,201,683 | 8/1965 | Hiermstad et al. | 323/45 |
| 3,353,094 | 11/1967 | Wentworth | 323/56 X |
| 3,541,428 | 11/1970 | Schwarz | 323/56 |
| 3,596,172 | 7/1971 | Harrison | 323/45 |

*Primary Examiner*—A. D. Pellinen

*Attorney, Agent, or Firm*—Lackenbach, Lilling & Siegel

[57] ABSTRACT

The proposed transformer control device is based on the magnetization principle and includes a voltage comparator unit, intermediate amplifiers and power amplifiers. The introduction of an additional intermediate amplifier and the connection of the inputs of the intermediate amplifiers in series opposition makes it possible to separately magnetize each yoke of the transformer. The separate magnetization of the transformer yokes instead of their differential magnetization substantially reduces the no-load current of the transformer, brings down the mean power required to control the magnetization of the yokes in the continuous voltage adjustment range, and thus raises the transformer's efficiency.

11 Claims, 2 Drawing Figures

TRANSFORMER CONTROL DEVICE

Figure 1:
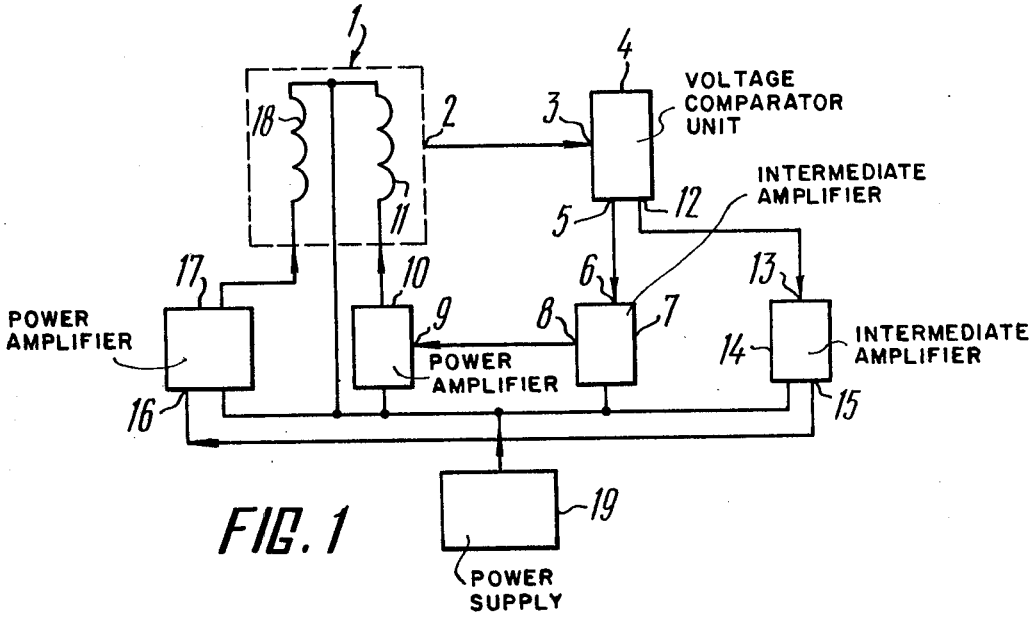

The present invention relates to control circuits and, more particularly, to transformer control devices, for example, devices featuring magnetization of two yokes of a transformer.

The invention is applicable to voltage regulators and stabilizers and power sources intended for different production processes, which are built around magnetization-controlled transformers.

One of the most important tasks in this field today is to develop and improve transformer control systems featuring magnetization of elements of a transformer, for example, yokes of the magnetic circuit, and thereby raise the efficiency of the transformer.

There is known a transformer control device featuring differential magnetization of a transformer's yokes. The device comprises a voltage comparator unit whose output is connected to an intermediate amplifier. The outputs of the intermediate amplifier are connected to the inputs of power amplifiers whose outputs are coupled to control windings of a transformer's yokes, whereby the control windings are successively brought into play.

The transformer's output voltage is applied to the voltage comparator unit. The latter sends an error signal to the input of the intermediate amplifier. The magnitude and polarity of said error signal are determined by the difference between the actual output voltage and its prescribed value. The function of the intermediate amplifier is performed by a contactless semiconductor relay, so the power amplifiers operate as switches.

If the output voltage is in excess of a prescribed magnitude, the control winding of the upper yoke is brought into play, whereas that of the medium yoke is disconnected. The current in the control winding of the upper yoke increases, whereas the current in the control winding of the medium yoke decreases. Accordingly, the reluctance of the upper yoke is increased, and that of the medium yoke is reduced. The flux linkage of the turns of the secondary winding, found in the upper window formed by the controlled yokes, is reduced, so the electromotive force induced in these turns is also reduced. The output voltage of the transformer goes down. When the output voltage becomes less than the prescribed magnitude, the polarity of the signal derived from the voltage comparator unit is reversed. As this takes place, the winding of the upper yoke is disconnected and that of the medium yoke is brought into play. The current in the control winding of the upper yoke decreases, while the current in the control winding of the medium yoke increases. The magnetic conductance of the upper yoke increases, and that of the medium yoke decreases. The flux linkage of the turns of the secondary winding found in the upper window increases. The electromotive force induced in these turns also increases, so the output voltage of the transformer goes up until it is in excess of the prescribed value.

Thus, by alternately bringing into play the upper and medium yokes and due to a certain sluggishness of the transformer's magnetic system, the output voltage is kept constant and within prescribed limits.

The device under review differentially controls the yokes of the transformer because, due to the inductance of the control windings and the presence of shunting diodes, the direct control current simultaneously flows both through the control winding of the medium yoke and through the control winding of the upper yoke, while stabilizing and regulating the voltage. Both yokes are magnetized, one of them being saturated to a lesser extent and the other, to a greater extent. When the regulator is in its medium position, both yokes are magnetized to an equal degree.

Both yokes are magnetized practically throughout the continuous voltage adjustment range, except the limiting values, so the resistance to the alternating flux is considerable. When the regulator is in certain positions, this accounts for a considerably high no-load current which is commensurable with the load current. Hence, the transformer's efficiency is low. When resorting to differential magnetization of a transformer's yokes, the power which is used to control said yokes always remains constant.

It is an object of the present invention to provide a transformer control device based on the magnetization principle, whose circuitry makes it possible to reduce the no-load current of the transformer and the mean power used to control the magnetization of the yokes within the continuous voltage adjustment range, and thus raise the transformer's efficiency.

The foregoing object is attained by providing a transformer control device featuring magnetization of at least two elements of the transformer's magnetic circuit, which device comprises a voltage comparator unit, its input being connected to the transformer, whereas its output is connected to an intermediate amplifier one of whose outputs is connected to one of a series of power amplifiers, each power amplifier being connected to one of control windings mounted on the magnetized elements of the transformer's magnetic circuit, which device is provided, according to the invention, with an additional intermediate amplifier placed in series opposition with the intermediate amplifier, the output of said additional intermediate amplifier being connected to another power amplifier, there being placed resistors in parallel with the inputs of the intermediate amplifier and the additional intermediate amplifier.

The invention makes it possible to substantially reduce the no-load current of a transformer by magnetizing at least two elements of the transformer's magnetic circuit. The invention also makes it possible to reduce power losses and control power. As a result, the invention makes it possible to raise the efficiency of the transformer.

Figure 2:
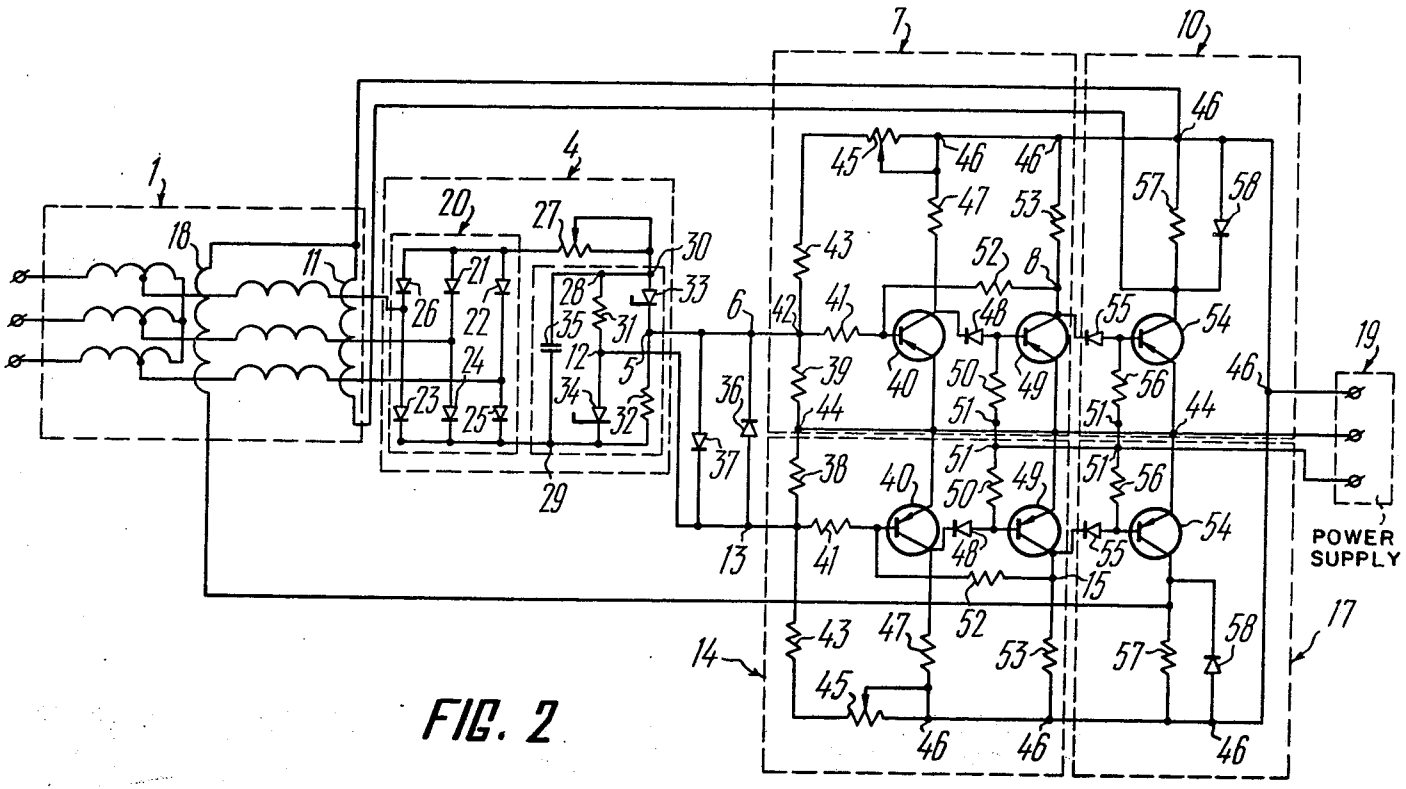

Other objects and advantages of the present invention will become more apparent from the following detailed description of a preferred embodiment thereof taken in conjunction with the accompanying drawings, wherein:

FIG. 1 is a block diagram of a transformer control device in accordance with the invention; and FIG. 2 is a key diagram of a transformer control device in accordance with the invention.

Referring now to the attached drawings, the proposed transformer control device, based on the magnetization principle, includes a transformer 1 (FIG. 1) whose output 2 is connected to an input 3 of a voltage comparator unit 4. A first output 5 of the voltage comparator unit 4 is connected to an input 6 of an intermediate amplifier 7. An output 8 of the intermediate amplifier 7 is connected to an input 9 of a power amplifier 10. The power amplifier 10 is connected to a control winding 11 of the transformer 1. A second output 12 of the voltage comparator unit 4 is connected to an input 13 of an additional intermediate amplifier 14. An output 15 of the additional intermediate amplifier 14 is connected to an input 16 of another power amplifier 17. The power amplifier 17 is connected to another control winding 18 of the transformer 1. Direct current is supplied to the intermediate amplifiers 7 and 14 and power amplifiers 10 and 17 from a power supply unit 19.

The voltage comparator unit 4 (FIG. 2) comprises a rectifier bridge 20 which includes diodes 21, 22, 23, 24, 25 and 26. The rectifier bridge 20 is connected via a resistor 27 to the diagonal between connection points 28 and 29 of a parametric bridge 30. The parametric bridge 30 comprises resistors 31 and 32, Zener or parametric diodes 33 and 34, and a capacitor 35 whose leads are connected to the connection points 28 and 29. The second diagonal of the parametric or non-linear bridge 30, between the outputs 5 and 12, is connected to diodes 36 and 37, which are placed in parallel opposition or back-to-back, as well as to series connected resistors 38 and 39 and the inputs 6 and 13 of the intermediate amplifiers 7 and 14.

The intermediate amplifier 7 includes a transistor 40. The base of the transistor 40 is connected via a resistor 41 and a connection point 42 to the output 5 of the voltage comparator unit 4. Also connected to the connection point 42 are leads of resistors 43 and 39. The second lead of the resistor 39 is connected to the emitter of the transistor 40 and, via a connection point 44, to the power supply unit 19. The second lead of the resistor 43 is connected via a resistor 45 and a connection point 46 to the power supply unit 19. The collector of the transistor 40 is connected via a resistor 47 and the connection point 46 to the power supply unit 19 and via a diode 48, to the base of a transistor 49. The emitter of the transistor 49 is connected via the connection point 44 to the power supply unit 19. The base of the transistor 49 is connected via a resistor 50 and a connection point 51 to the power supply unit 19. The collector of the transistor 49 is connected via a resistor 52 to the base of the transistor 40 and via a resistor 53 and the connection point 46, to the power supply unit 19.

The power amplifier 10 comprises a transistor 54. The base of the transistor 54 is connected via a diode 55 to the output 8 of the intermediate amplifier 7 and via a resistor 56 and the connection point 51, to the power supply unit 19. The emitter of the transistor 54 is connected via the connection point 44 to the power supply unit 19. The collector of the transistor 54 is connected via a resistor 57, a diode 58 and the control winding 11, which are placed in parallel, to the power supply unit 19. The circuitry of the additional intermediate amplifier 14 is similar to that of the intermediate amplifier 7. The circuitry of the power amplifier 17 is similar to that of the power amplifier 10.

The output voltage of the transformer 1 (FIG. 1) is applied to the voltage comparator unit 4. From the outputs 5 and 12 of the voltage comparator unit 4 there is sent an error signal to the inputs 6 and 13 of the intermediate amplifiers 7 and 14, which inputs are placed in series opposition. The magnitude and polarity of the error signal is determined by the deviation of the output voltage from a prescribed value. The function of the intermediate amplifiers 7 and 14 is performed by polarized contactless relays.

When stabilizing and regulating voltage, a positive signal is applied, for example, to the input 6 of the intermediate amplifier 7, and a negative signal is applied to the input 13 of the additional intermediate amplifier 14. The intermediate amplifier 7, to whose input 6 there is applied the positive signal, does not change its state in the course of voltage adjustment and keeps the power amplifier 10 non-conducting. Thus, with a signal of positive polarity, there is no current through the control winding 11 which is connected to the power amplifier 10. The state of the additional intermediate amplifier 14, to whose input 13 there is applied the negative signal, is changed, depending on the magnitude of said negative signal. Accordingly, the state of the power amplifier 17 whose input 16 is connected to the additional intermediate amplifier 14 is changed. Consequently, the current in the control winding 18 of the transformer 1, which is connected to the power amplifier 17, is changed so as to bring the output voltage back to the prescribed value.

If the prescribed load current magnitude is changed or if there are fluctuations of the supply voltage, the polarity of the error signal is reversed. A negative signal is applied to the input 6 of the intermediate amplifier 7, and a positive signal is applied to the input 13 of the additional intermediate amplifier 14. In this case, the additional intermediate amplifier 14 does not change its state, so the power amplifier 17 is kept non-conducting. There is no current in the control winding 18 of the transformer 1. On the other hand, the intermediate amplifier 7, to whose input there is applied the negative signal, changes its state, depending on the magnitude of this signal. The power amplifier 10 changes its state accordingly, and the current in the control winding 11 of the transformer 1 is changed so as to eliminate the deviation of the output voltage from the prescribed value.

Thus, in the course of voltage adjustment and stabilization, the current in one of the control windings 11 and 18 is zero, whereas in the other winding it changes, depending upon the degree of deviation of the output voltage from the prescribed value. This means that in the course of voltage adjustment, only one of the controlled yokes of the transformer 1 is magnetized.

Unlike in the case of differential magnetization of transformer yokes, when both yokes are magnetized in the course of voltage adjustment, the proposed method contemplates magnetization of only one yoke of a transformer. This technique is referred to as individual magnetization.

The relay effect of the intermediate amplifier 7 is due to the positive feedback between the collector of the transistor 49 (FIG. 2), the resistor 52 and the base of the transistor 40. The diodes 36 and 37 protect the inputs 6 and 13 of the intermediate amplifiers 7 and 14 from overvoltages in the transient conditions. The resistors 38 and 39 ensure the passage of current through the emitter-base junction of the transistor 40 at a specified polarity.

The diode 58 protects the transistor 54 from overvoltages and switchings and ensures continuity of current in the control windings 11 and 18. The resistor 45 is meant to increase the sensitivity of the intermediate amplifiers 7 and 14.

Thus, the introduction of the additional intermediate amplifier 14 and the connection of the inputs 6 and 13 of the intermediate amplifiers 7 and 14 in series opposition account for individual magnetization of the yokes of the transformer 1, which substantially reduces the no-load current of the transformer 1, decreases the mean power required to control the magnetization of the yokes of the transformer 1 in the continuous voltage adjustment range, and, as a result, makes it possible to raise the efficiency of the transformer 1.

What is claimed is:

1. A transformer control device featuring magnetization of at least two elements of a transformer's magnetic circuit, comprising:

a voltage comparator unit having an input connected to the output of said transformer and two outputs adapted to provide opposing polarities, the relative polarities at said outputs being a function of the output voltage of the transformer;

a first intermediate amplifier having an input and an output, said input of said intermediate amplifier being connected to one of said outputs of said voltage comparator unit;

a second intermediate amplifier having an input and an output, said input of said second intermediate amplifier being connected to another of said outputs of said voltage comparator unit;

control windings of said transformer, mounted on said two elements of the magnetic circuit; and power amplifiers having inputs and outputs, the input and output of one of said power amplifiers being respectively connected to the output of said first intermediate amplifier and one of said control windings and the input and output of another of said power amplifiers being respectively connected to the output of said second intermediate amplifier and another of said control windings, said intermediate and power amplifiers being arranged to cause only one power amplifier to drive a current through an associated control winding for a given relative polarity at said voltage comparator outputs, whereby the current is zero in one of the control windings and a current flows in the other control winding and thereby only one of the elements of a transformer's magnetic circuit is magnetized at any given time.

2. A transformer control device as defined in claim 1, further comprising two resistors one of which is placed in parallel with said input of said first intermediate amplifier, the other of said two resistors being placed in parallel with said input of said second intermediate amplifier.

3. A transformer control device as defined in claim 1, wherein said voltage comparator unit comprises a parametric or non-linear bridge.

4. A transformer control device as defined in claim 3, wherein said voltage comparator unit further includes a rectifier bridge connected between said transformer and said parametric or non-linear bridge.

5. A transformer control device as defined in claim 1, wherein said voltage comparator unit comprises a rectifier bridge; a parametric or non-linear bridge having diagonal connection points; and means for connecting said rectifier bridge to said diagonal connection points.

6. A transformer control device as defined in claim 5, wherein said means comprises a resistor.

7. A transformer control device as defined in claim 6, wherein said resistor is adjustable.

8. A transformer control device as defined in claim 1, wherein said voltage comparator unit comprises a parametric or non-linear bridge defining two sets of diagonal connection points, and a rectifier bridge connected between said transformer and one set of diagonal connection points, the other set of diagonal connection points being connected to said intermediate amplifiers.

9. A transformer control device as defined in claim 8, wherein a resistor is connected between said rectifier bridge and said one set of diagonal connection points; and further comprising a capacitor connected between said one set of diagonal connection points.

10. A transformer control device as defined in claim 8, further comprising a pair of back-to-back diodes in parallel opposition to each other; which diodes are disposed between said other set of diagonal connection points and said intermediate amplifiers.

11. A transformer control device as defined in claim 1, wherein said voltage comparator unit includes a parametric or non-linear bridge which comprises resistors and Zener or parametric diodes.

* * * * *